US007866276B2

(12) United States Patent
Mangelsen

(10) Patent No.: US 7,866,276 B2
(45) Date of Patent: Jan. 11, 2011

(54) SPIDERWEB MAKER

(75) Inventor: Matthew D. Mangelsen, LaVista, NE (US)

(73) Assignee: The David M. Mangelsen Group, Inc., Omaha, NE (US)

( * ) Notice: Subject to any disclaimer, the term of this patent is extended or adjusted under 35 U.S.C. 154(b) by 979 days.

(21) Appl. No.: 11/715,115

(22) Filed: Mar. 7, 2007

(65) Prior Publication Data

US 2008/0135644 A1 Jun. 12, 2008

Related U.S. Application Data

(60) Provisional application No. 60/872,186, filed on Dec. 1, 2006.

(51) Int. Cl.

| | |
|---|---|
| ***B05C 5/00*** | (2006.01) |
| ***B05B 7/16*** | (2006.01) |
| ***B05B 1/24*** | (2006.01) |
| ***B05B 7/02*** | (2006.01) |

(52) U.S. Cl. ..... 118/300; 118/302; 239/133; 239/525

(58) Field of Classification Search ..... 118/300, 118/302; 239/133, 322, 298, 418, 525; 222/146.5, 222/325, 146.2; 401/2; 427/207.1, 427.1; 219/227, 421

See application file for complete search history.

(56) References Cited

U.S. PATENT DOCUMENTS 5,375,766 A * 12/1994 Sweeney ..... 239/133

* cited by examiner

*Primary Examiner*—Yewebdar T Tadesse
(74) *Attorney, Agent, or Firm*—Dennis L. Thomte; Thomte Patent Law Office LLC

(57) ABSTRACT

The present invention is a spiderweb maker gun comprising a body having a handle, a trigger, and a discharge nozzle. A source of pressurized air is supplied to an air inlet which is secured to the handle of the gun and which is controlled by an adjustable air valve. The discharge side of the air valve has an air conduit extending therefrom which has an air discharge end or nozzle positioned below the glue discharge nozzle so that pressurized air is directed into the stream of hot glue falling or dropping from the glue discharge nozzle. The pressurized air blows the hot glue in a stream towards the area where the spiderweb is to be created with the glue drying and cooling as it is being blown from the gun. The gun is selectively moved while the stream of hot glue is being blown therefrom to create the spiderweb pattern.

3 Claims, 4 Drawing Sheets

SPIDERWEB MAKER

CROSS-REFERENCE TO RELATED APPLICATION

This application claims the benefit of U.S. Provisional Application Ser. No. 60/872,186 entitled "SPIDER WEB MAKER" filed Dec. 1, 2006, the disclosure of which is hereby incorporated herein by reference.

BACKGROUND OF THE INVENTION

1. Field of the Invention

This invention relates to a spiderweb maker and more particularly to a spiderweb maker which is in the form of a modified hand-held glue gun having a supply of air under pressure added thereto to enable hot glue to be blown from the glue gun to create a spiderweb which may be attached to doorways, windows, trees, walls, etc., for decorative purposes such as Halloween.

2. Description of the Related Art

Glue guns have been used for many years for applying hot glue or adhesive to surfaces or objects for gluing purposes. Normally, the hot glue is ejected from the glue gun by means of a pump-like trigger which discharges a predetermined amount of hot glue from the nozzle of the glue gun with each cycle of the trigger. Applicant has discovered that if the hot glue is discharged from the glue gun so as to drop downwardly into the path of pressurized air, the glue will be blown from the gun and will cool and dry in the air and that a person may manipulate the gun to form spiderwebs for decorative purposes such as Halloween or the like.

SUMMARY OF THE INVENTION

A spiderweb maker or gun is disclosed which includes a modified conventional glue gun adapted to discharge hot glue or adhesive therefrom from a glue discharge nozzle. A source of pressurized air is attached to the glue gun with the air discharge nozzle thereof being located below the glue discharge nozzle so that discharged glue will fall downwardly into the path of discharged air so that the glue will be blown through the air for approximately six to ten feet to enable it to be attached to a supporting surface. The gun may be maneuvered to create a spiderweb suitable for decorative use such as in Halloween decorations.

It is therefore a principal object of the invention to provide a spiderweb maker gun.

A further object of the invention is to provide a spiderweb maker which is adapted to discharge glue into the path of a stream of pressurized air so that a spiderweb may be formed.

A further object of the invention is to provide a spiderweb maker in the shape of a hand-held gun.

These and other objects will be apparent to those skilled in the art.

DETAILED DESCRIPTION OF THE INVENTION

Figure 1:
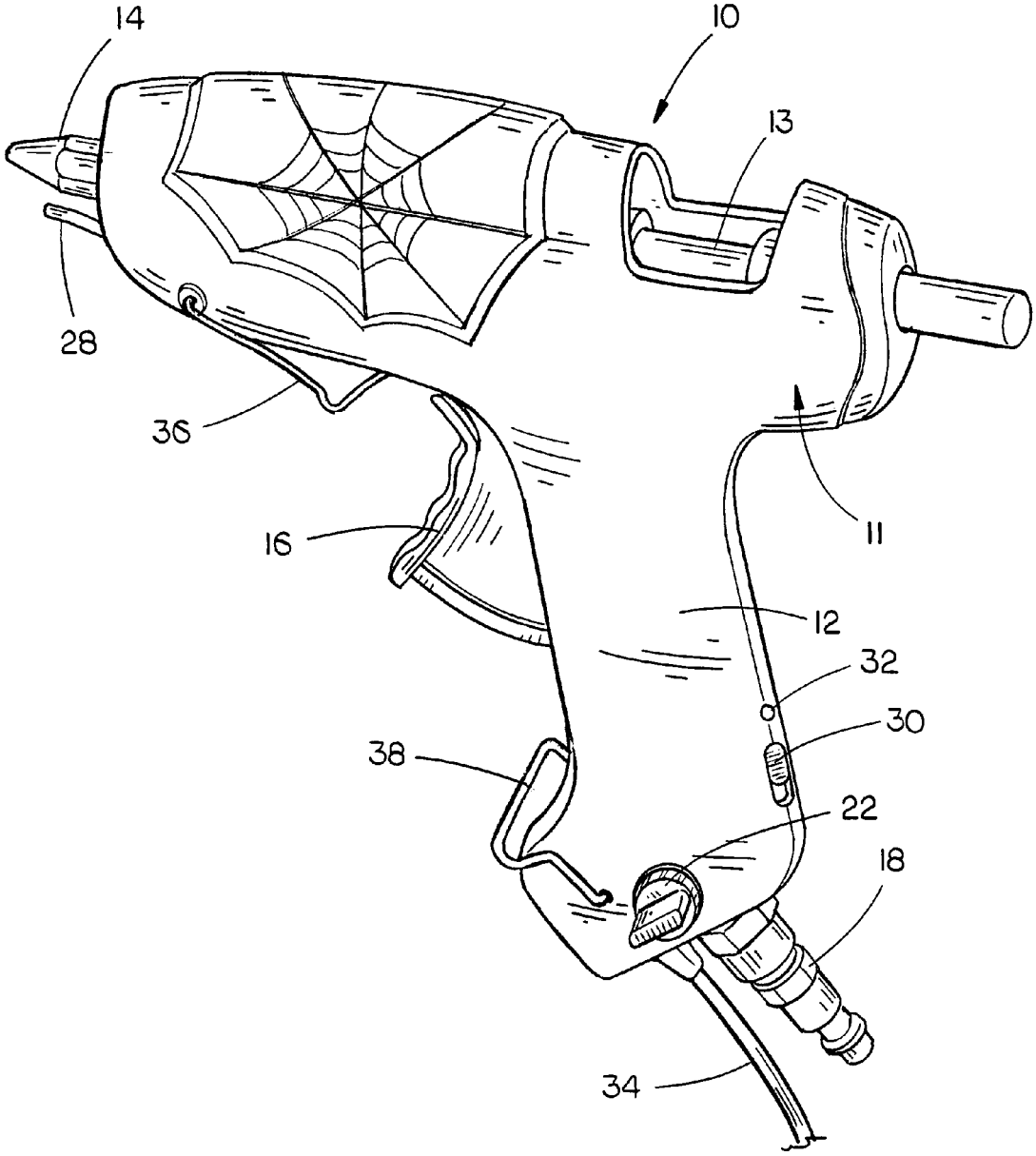
FIG. 1 is a perspective view of the spiderweb maker gun of this invention.
Figure 2:
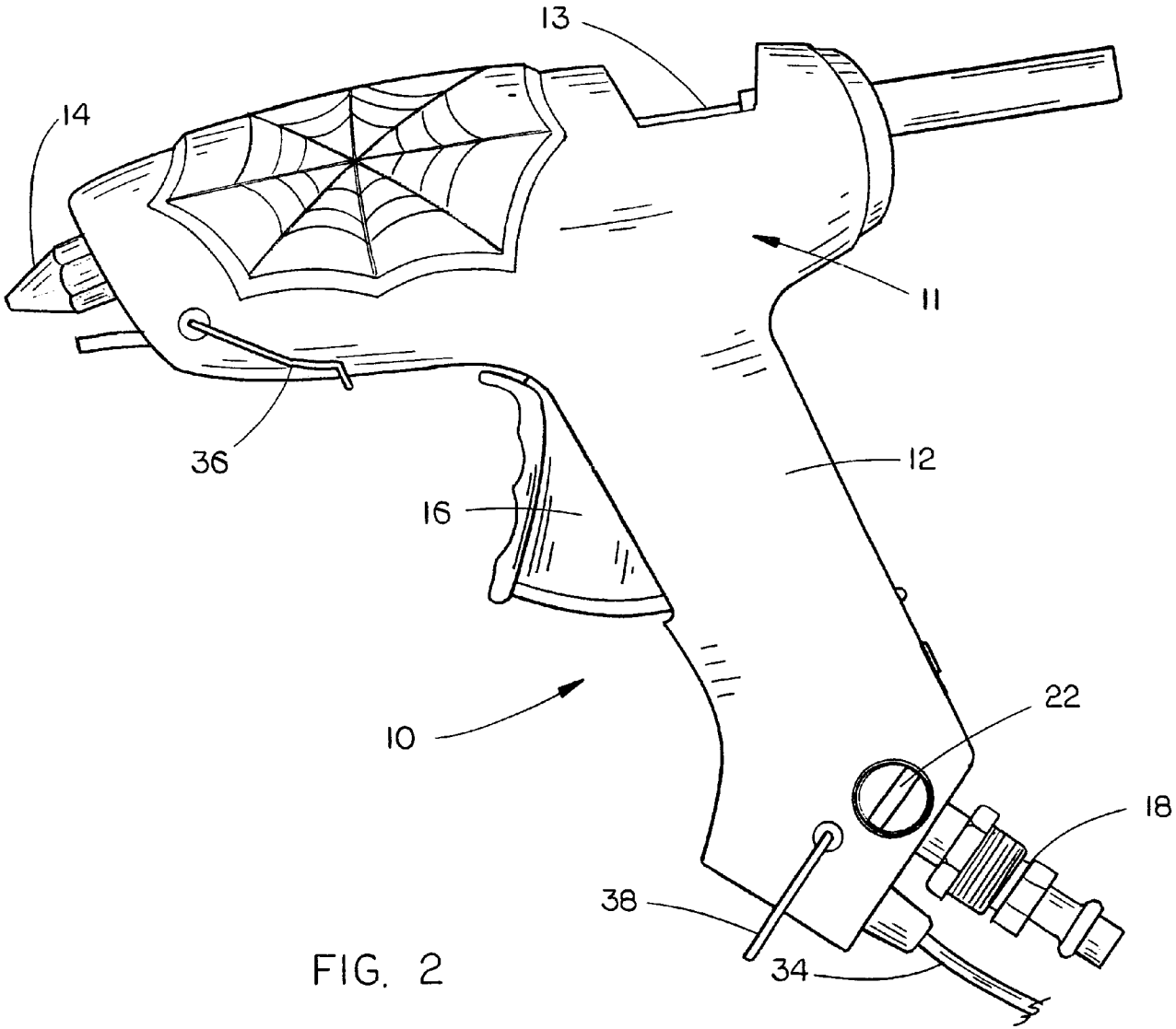
FIG. 2 is a side view of the spiderweb maker gun of this invention.

The numeral 10 refers to the spiderweb maker gun of this invention which is in the form of a hand-held gun including a body 11, a handle 12 and a discharge nozzle 14. The structure just described is a conventional glue gun which is designed to receive glue or adhesive cartridges 13 therein in conventional fashion and to heat the same for discharge therefrom when the trigger 16 is actuated. When the trigger 16 is depressed, a predetermined amount of hot glue or adhesive is discharged from the nozzle 14. The nozzle of the conventional glue gun normally directs the glue outwardly therefrom in a straight line. The discharged glue will drop or fall downwardly therefrom as will be described in more detail hereinafter.

Figure 4:
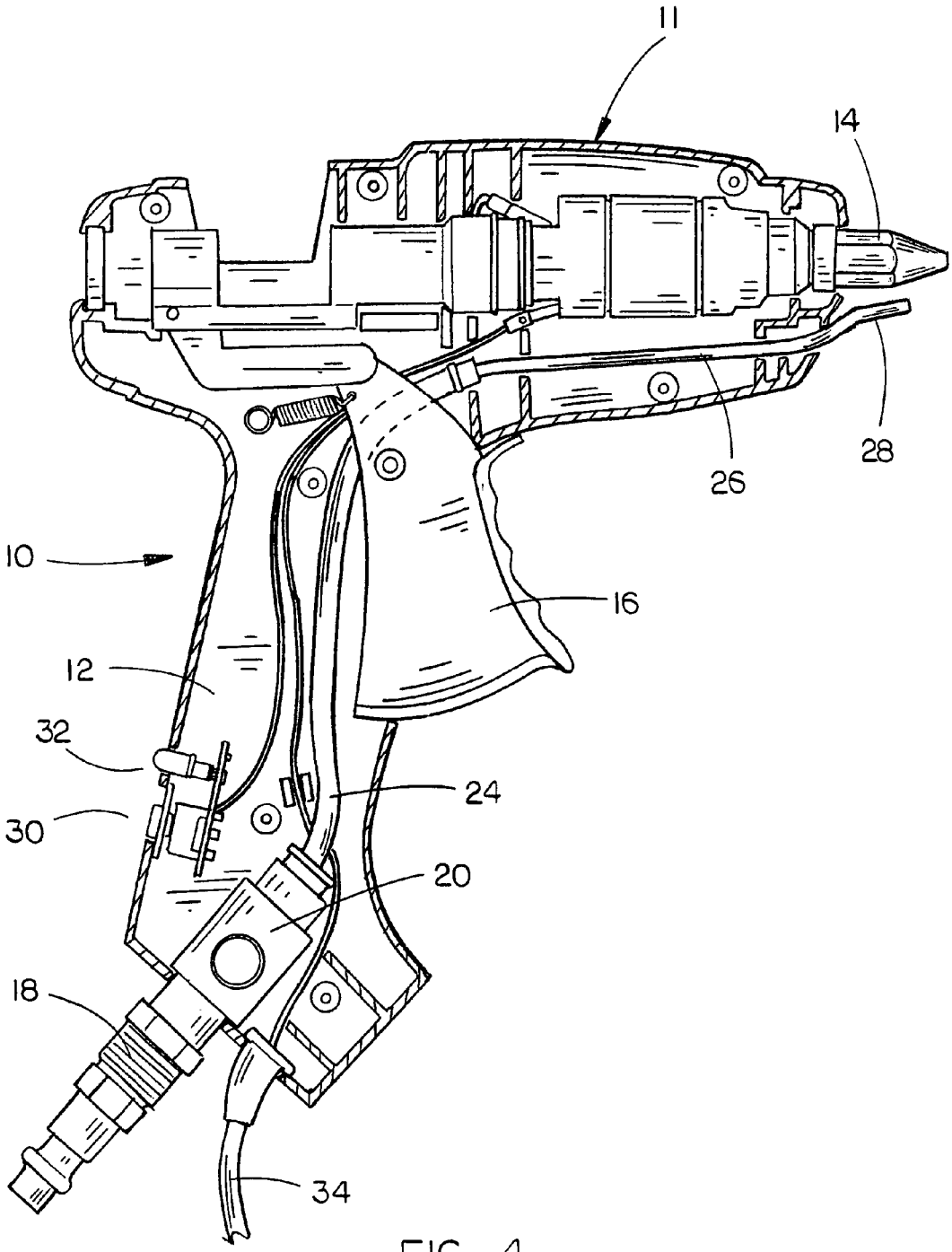
FIG. 4 is a partial schematic of the means for supplying pressurized air to the gun.

In order to create a spiderweb 17, a source of pressurized air is attached to an air inlet 18 secured to the gun handle. Inlet 18 is connected to a variable volume valve 20 (FIG. 4) which is controlled by a rotatable knob 22. A flexible air tube 24 extends from the discharge side of valve 20 to a metal tube 26 having a discharge end 28 adapted to direct pressurized air into the stream of hot glue being ejected from the glue discharge nozzle 14 which falls or drops downwardly from the glue discharge nozzle 14. The amount of air being directed into the stream of glue is controlled by the rotatable knob 22 which may be moved between "on" and "off" positions and positions therebetween.

The gun 10 includes conventional means for heating the glue being dispensed therefrom. Gun 10 also includes an "on-off" switch 30 which controls the conventional glue heater in the gun 10. Light 32 indicates when the glue heater is in operation. The conventional glue heater is electrically powered by means of the electrical cord 34 which is connected to a source of AC power. If desired, the conventional glue heater could be powered by a DC battery or batteries. Gun 10 also includes a pair of selectively pivotally movable supports 36 and 38 for supporting the hot glue gun on a support surface in conventional fashion.

Figure 3:
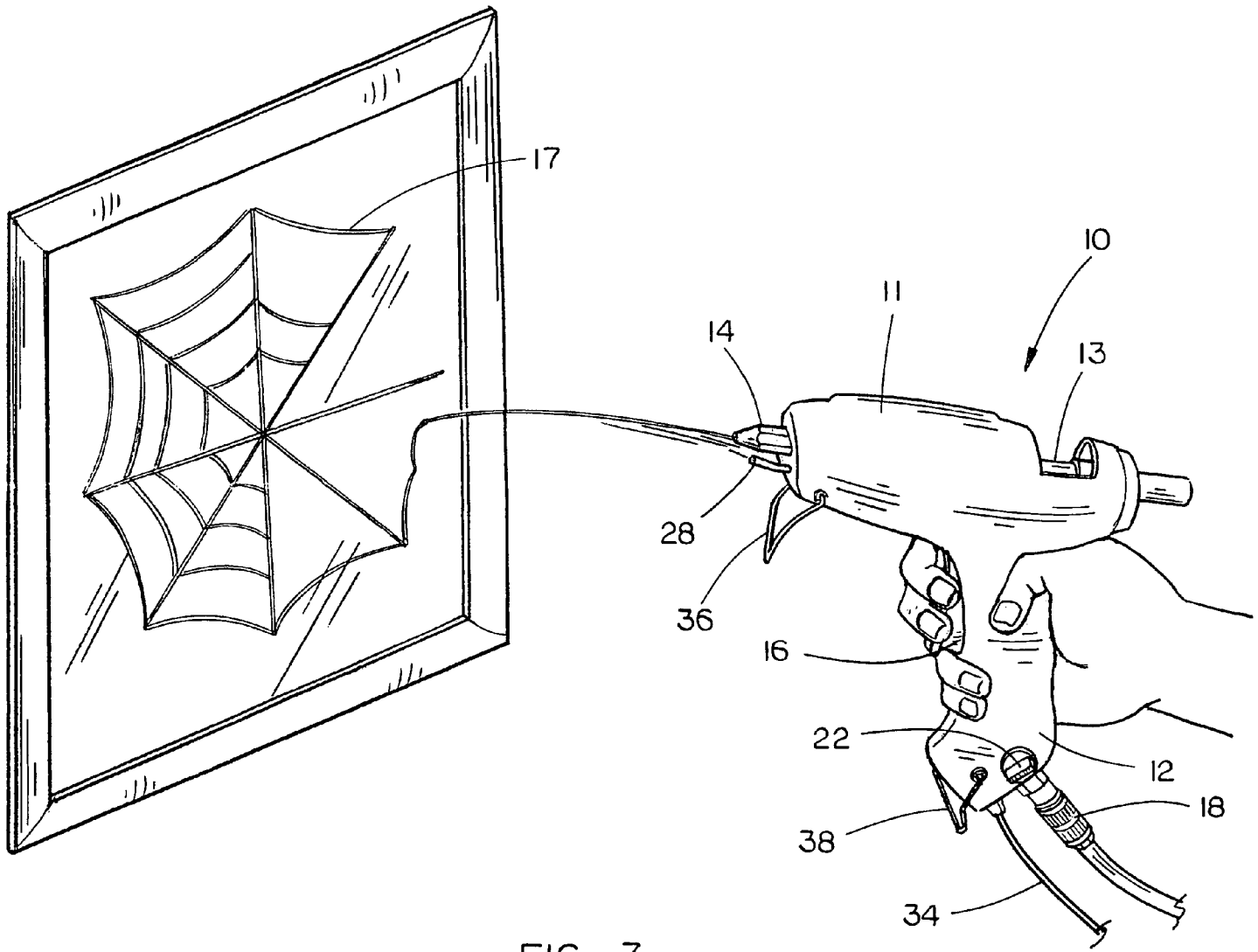
FIG. 3 is a perspective view illustrating the spiderweb maker of this invention being used to create a spiderweb on a window.

When it is desired to create a spiderweb 17, the operator will insert a glue stick or cartridge 13 into the gun 10 in conventional fashion. Switch 30 will be then moved to the "on" position to cause the glue in the glue stick or cartridge to be heated. When the glue stick or cartridge has been sufficiently heated, the operator will then open the valve 20 by way of the knob 22 so that pressurized air is discharged from the discharge end 28. The operator then depresses or cycles the trigger 16 to cause hot glue to be discharged from the glue discharge nozzle 14 into the stream of pressurized air. The pressurized air blows the hot glue in a stream towards the area where the spiderweb 17 is to be created, as seen in FIG. 3. The operator then moves the gun, and thus the stream of hot glue, in a pattern to create a spiderweb 17. The hot glue dries and cools as it is being blown towards the surface or area where the spiderweb is to be created so that the spiderweb remains in place after it has been formed.

Thus it can be seen that a novel spiderweb maker has been provided which converts a conventional hot glue gun into a spiderweb maker by attaching an air line or air hose thereto wherein the discharge therefrom is directed into a stream of glue being discharged from the glue discharge nozzle 14 to create spiderwebs.

Thus it can be seen that the invention accomplishes at least all of its stated objectives.

I claim:

1. A spiderweb maker, comprising:

a hand-held hot glue gun including a hot glue discharge nozzle which discharges a single stream of hot glue therefrom;

said hand-held hot glue gun having a source of pressurized air connected thereto;

said hand-held hot glue gun having an air discharge nozzle positioned below said hot glue discharge nozzle;

said air discharge nozzle being in operative communication with said source of pressurized air;

said single stream of hot glue being discharged from said hot glue discharge nozzle falling downwardly therefrom into the pressurized air being discharged from said air discharge nozzle whereby said single stream of hot glue will be blown away from said hand-held hot glue gun to enable a user of said hand-held hot glue gun to create a spiderweb on a supporting surface;

said hand-held hot glue gun having a source of pressurized air connected thereto;

said hand-held hot glue gun having said air discharge nozzle positioned thereon, which is fluidly connected to the source of pressurized air, which directs the pressurized air into the hot glue being discharged from said hot glue discharge nozzle to blow the hot glue therefrom to enable the user of said hand-held got glue gun to maneuver said hand-held hot glue gun to create a spiderweb on a supporting surface.

2. The spiderweb maker of claim 1 wherein said hand-held hot glue gun includes a variable volume valve which is operatively associated with the source of pressurized air to control the volume of pressurized air being supplied to said air discharge nozzle.

3. The spiderweb maker of claim 1 wherein said hand-held hot glue gun includes a movable trigger which controls the flow of hot glue from said hot glue discharge nozzle.

* * * * *